US009585484B1

(12) United States Patent
Tsai

(10) Patent No.: US 9,585,484 B1
(45) Date of Patent: Mar. 7, 2017

(54) BACK SUPPORT CUSHION DEVICE FOR CHAIR

(71) Applicant: SING BEE ENTERPRISE CO., LTD., Nantou, Nantou County (TW)

(72) Inventor: Chi-Cheng Tsai, Nantou (TW)

(73) Assignee: Sing Bee Enterprise Co., Ltd., Nantou (TW)

( * ) Notice: Subject to any disclaimer, the term of this patent is extended or adjusted under 35 U.S.C. 154(b) by 22 days.

(21) Appl. No.: 14/823,099

(22) Filed: Aug. 11, 2015

(51) Int. Cl.
*A47C 7/40* (2006.01)
*A47C 7/44* (2006.01)
*A47C 7/38* (2006.01)

(52) U.S. Cl.
CPC ..... *A47C 7/448* (2013.01); *A47C 7/38* (2013.01); *A47C 7/40* (2013.01); *A47C 7/405* (2013.01); *A47C 7/44* (2013.01)

(58) Field of Classification Search
CPC .. A47C 7/448; A47C 7/44; A47C 7/40; A47C 7/38; A47C 7/405
USPC ..... 297/291, 299, 285, 354.1, 404
See application file for complete search history.

(56) References Cited

U.S. PATENT DOCUMENTS 2,429,472 A * 10/1947 Maxson ..... A47C 1/10 297/404
3,934,930 A * 1/1976 Sandham ..... A47C 7/445 297/291
4,400,032 A * 8/1983 dePolo ..... A47C 3/18 248/416
4,602,818 A * 7/1986 Korn ..... A47C 7/46 297/291
5,104,190 A * 4/1992 Siegrist ..... B60N 2/22 297/354.1
6,116,687 A * 9/2000 Vogtherr ..... A47C 3/026 297/291
7,278,688 B1 * 10/2007 Hung ..... A47C 7/024 297/285
7,427,107 B2 * 9/2008 Yang ..... A47C 7/448 297/291
7,490,901 B2 * 2/2009 Maier ..... A47C 7/448 297/291
2010/0148554 A1 * 6/2010 Yang ..... A47C 7/443 297/291

(Continued)

FOREIGN PATENT DOCUMENTS

DE 20 2015 005 534 U1 * 11/2015
TW M484353 U * 8/2014
TW M509597 U * 10/2015

*Primary Examiner* — Robert Canfield
(74) *Attorney, Agent, or Firm* — Alan D. Kamrath; Kamrath IP Lawfirm, P.A.

(57) ABSTRACT

A back support cushion device includes a support member, at least one cushion assembly, and at least one elastic assembly. The support member includes a first groove. The cushion assembly includes a second groove. The elastic assembly is located between the support member and the cushion assembly and includes an elastic member, and first and second members. The elastic member includes first and second portions. The first portion is engaged into the first groove, and the second portion is engaged into the second groove. The first member includes a first end disposed in the first portion and a second end connected to the first groove. The second member includes a first end disposed in the second portion and a second end connected to the second groove.

10 Claims, 10 Drawing Sheets

(56) References Cited

U.S. PATENT DOCUMENTS

2010/0264718 A1* 10/2010 Hwong ..... A47C 7/40
297/463.1

* cited by examiner

BACK SUPPORT CUSHION DEVICE FOR CHAIR

BACKGROUND OF THE INVENTION

The present invention relates to a cushion device for use with an office chair to support a person's back while seated in the office chair.

Most chairs, especially office chairs, are designed to accommodate a person of average size and build in present use. Thus, many people find even a well designed chair uncomfortable and tired when the person sits in the chair all day, such as in an office. The problem is especially acute with secretaries, computer terminal operators and those that have chronic back problems, because the chair provided with a back support cushion cannot adequately support the person's back.

Thus, a need exists for a novel back support cushion device for a chair to mitigate and/or obviate the above, disadvantages.

BRIEF SUMMARY OF THE INVENTION

A back support cushion device according to the present invention includes a support member, at least one cushion assembly, and at least one elastic assembly. The support member includes at least one first groove. The at least one cushion assembly includes a second groove. The at least one elastic assembly is located between the support member and the at least one cushion assembly. The at least one elastic assembly includes an elastic member, a first joining member, and a second joining member. The elastic member includes a first engaging portion and a second engaging portion spaced from the first engaging portion. The first engaging portion includes a first exterior surface having at least two different curvatures and is engaged into the at least one first groove of the support member. The second engaging portion includes a second exterior surface having at least two different curvatures and is engaged into the second groove of the at least one cushion assembly. The first joining member includes a first end and a second end space from the first end thereof. The first end of the first joining member is disposed in the first engaging portion of the elastic member. The second end of the first joining member is connected to a bottom section of the at least one first groove of the support member. The second joining member includes a first end and a second end space from the first end thereof. The first end of the second joining member is disposed in the second engaging portion of the elastic member. The second end of the second joining member is connected to a bottom section of the second groove of the at least one cushion assembly.

Other objectives, advantages, and novel features of the present invention will become clearer in light of the following detailed description described in connection with the accompanying drawings.

DESCRIPTION OF THE DRAWINGS

The illustrative embodiments may best be described by reference to the accompanying drawings where.

Figure 1:
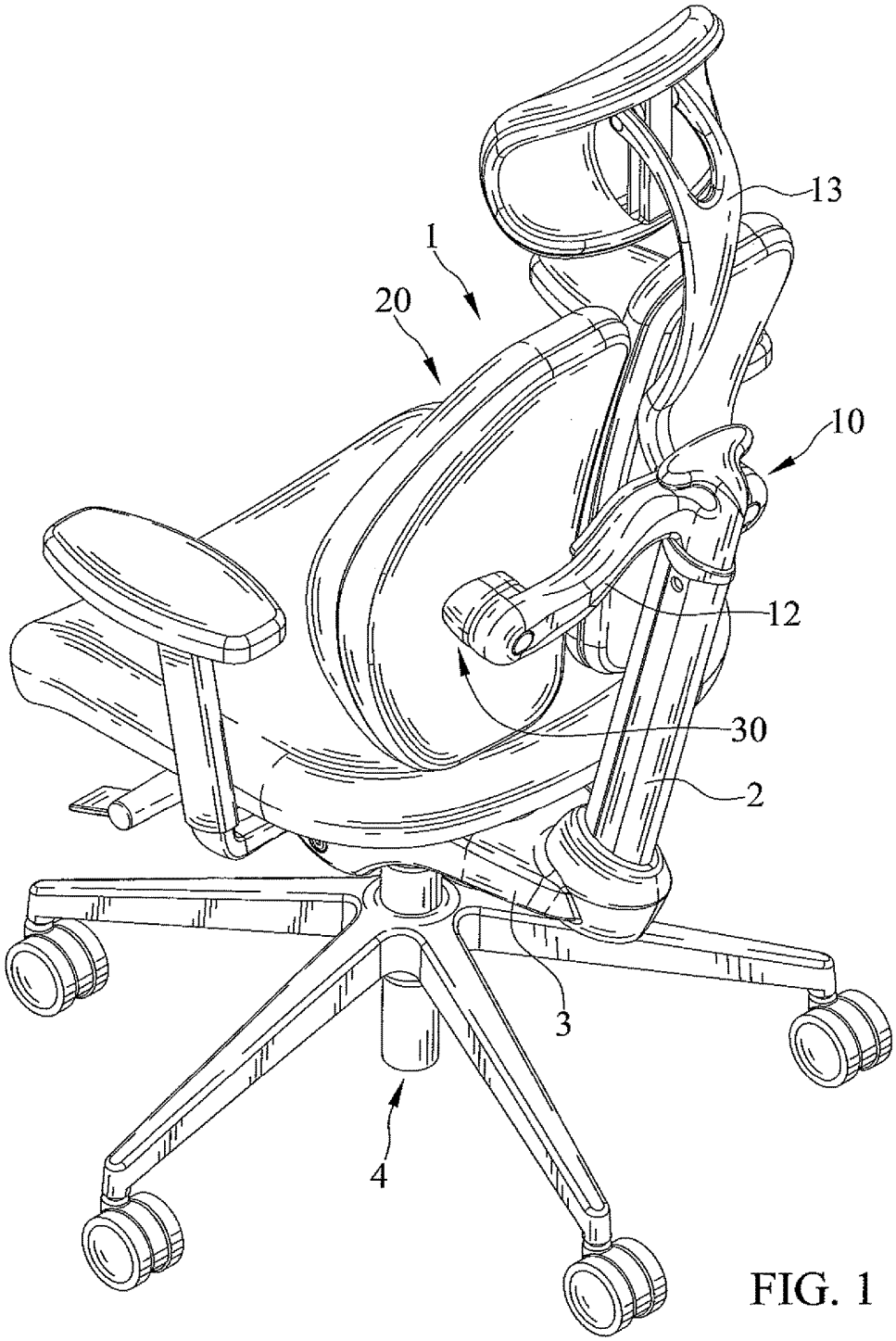
FIG. 1 is a perspective view of a back support cushion device according to the present invention, and illustrating the back support cushion device mounted to a support column of an office chair.
Figure 2:
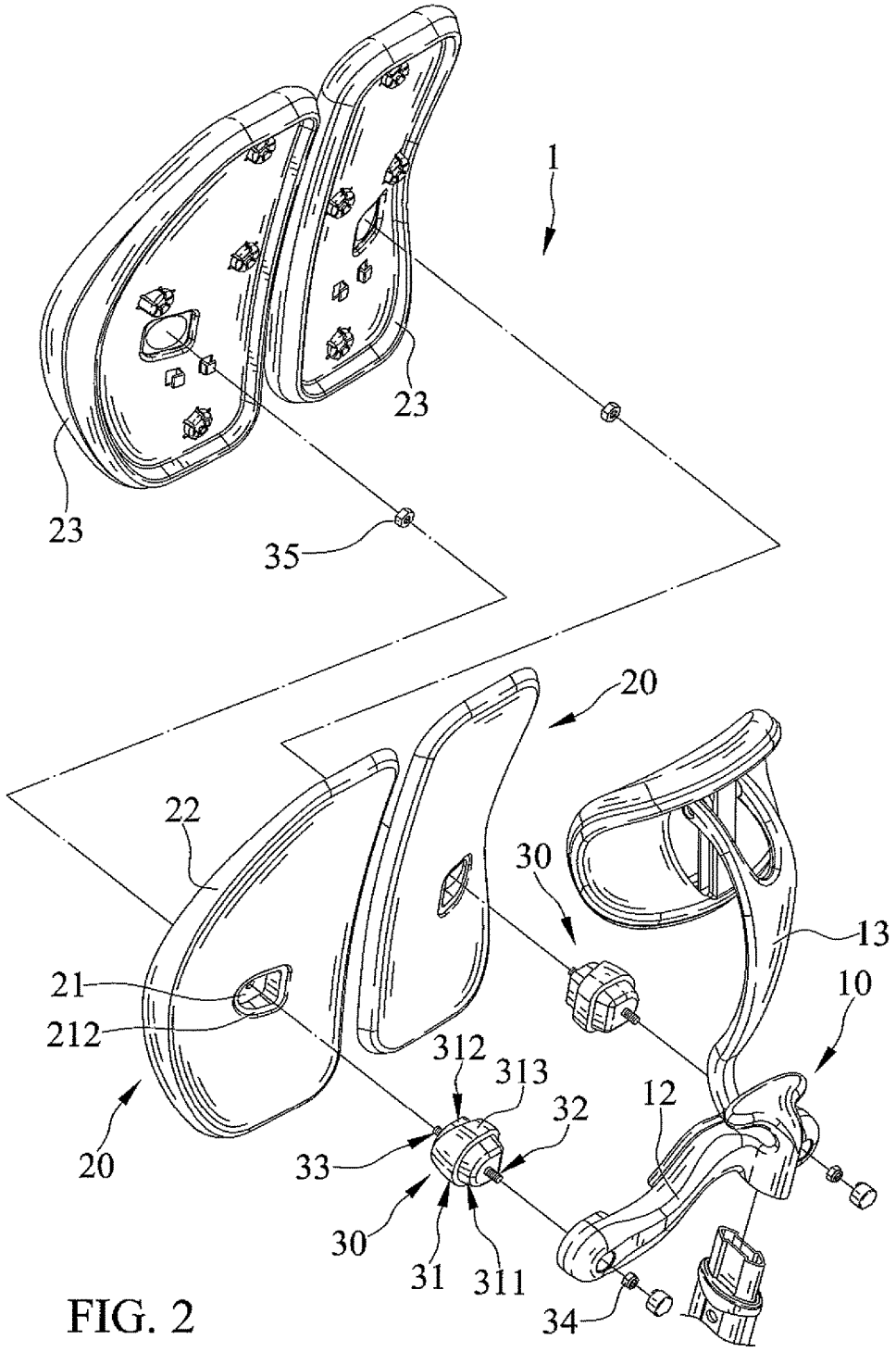
FIG. 2 is a partial, exploded perspective view of the back support cushion device of FIG. 1.
Figure 3:
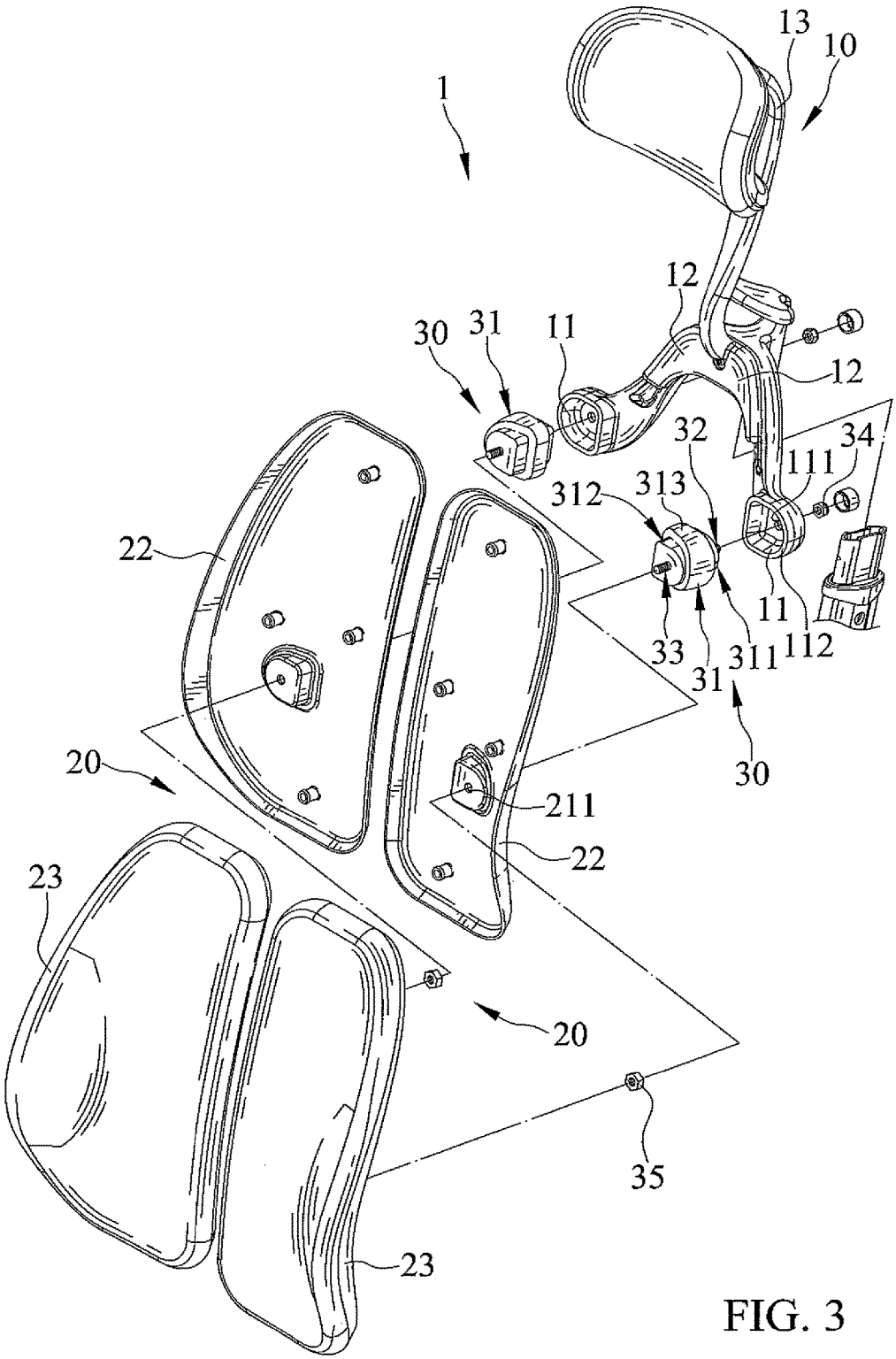
FIG. 3 is another partial, exploded perspective view of the back support cushion device of FIG. 1.
Figure 4:
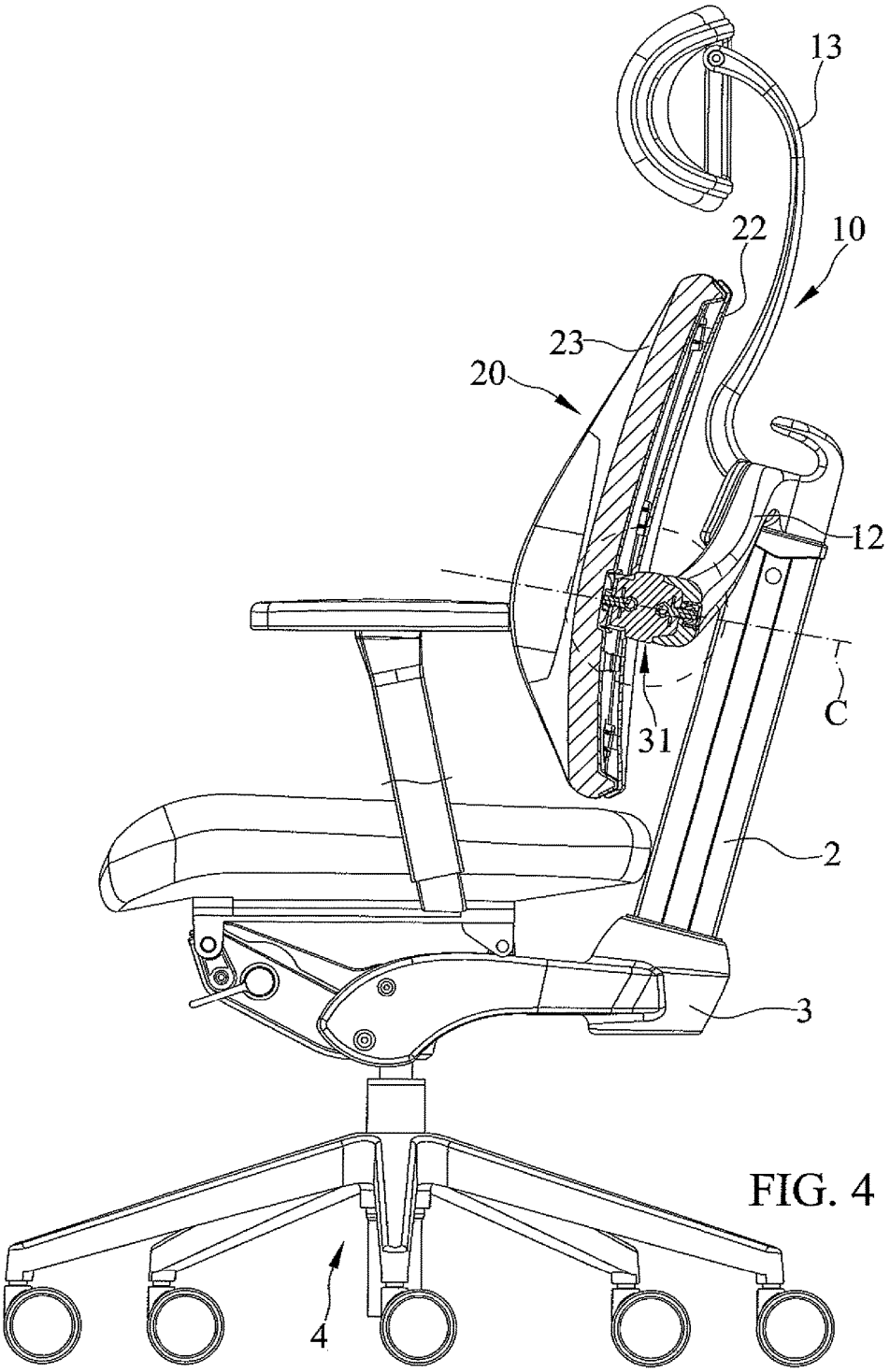
FIG. 4 is a partial, cross sectional view of the back support cushion device of FIG. 1.
Figure 5:
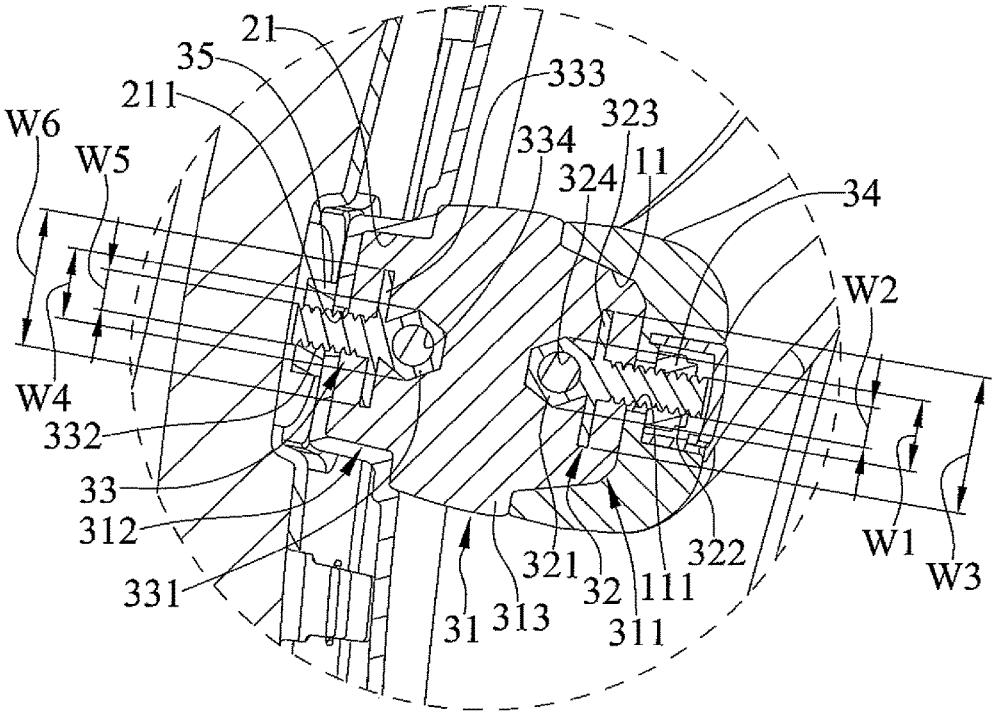
FIG. 5 is a partial, enlarged view of the back support cushion device of FIG. 4 encompassed by the broken line circle.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "side", "end", "portion", "spacing", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

FIGS. 1-10 show a back support cushion device 1 according to the present invention is adapted to mount on a support column 2 of a chair. The support column 2 is connected to a seat 3 adapted to seat a person. The seat 3 is secured to a base 4, which is movably supported on a floor by a plurality of casters or the like.

The back support cushion device 1 includes a support member 10, at least one cushion assembly 20, and at least one elastic assembly 30. In the embodiment, the back support cushion device 1 preferably includes a pair of cushion assembly 20 and a pair of elastic assembly 30.

The support member 10 is adapted to mount on the support column 2 of the chair and includes at least one first groove 11, at least one arm portion 12, and a head support 13. In the embodiment, the support member 10 includes a pair of first grooves 11 and a pair of arm portions 12. Each first groove 11 is integrally formed on a terminal end of each arm portion 12. Each first groove 11 includes a through-hole 111 formed through a bottom section thereof and a first positioning section 112 formed around an end face thereof. The head support 13 is located between the pair of arm portions 12 and is adapted to support a person's head when the person sits in the chair.

Each cushion assembly 20 includes a second groove 21, a shell 22, and a cushion pad 23. The second groove 21 is formed on a back surface of the shell 22 facing to the arm portion 12 of the support member 10. The second groove 21 includes a through-hole 211 formed through a bottom section thereof and a second positioning section 212 formed around an end face thereof and expanding therefrom. The cushion pad 23 is formed of a soft material and is mounted to a front surface of the shell 22.

Each elastic assembly 30 is located between the support member 10 and each cushion assembly 20. Each elastic assembly 30 includes an elastic member 31, a first joining member 32, and a second joining member 33.

The elastic member 31 includes a first engaging portion 311, a second engaging portion 312 spaced from the first engaging portion 311 along a centerline C extending therethrough, and an expansion 313 located between the first engaging portion 311 and second engaging portion 312. The first engaging portion 311 includes a first exterior surface having at least two different curvatures, and the first engaging portion 311 is engaged into the first groove 11 of the support member 10, so that the first exterior surface of the first engaging portion 311 closely fits a first interior surface of the first groove 11. The second engaging portion 312 includes a second exterior surface having at least two different curvatures, and the second engaging portion 312 is engaged into the second groove 21 of each cushion assembly 20, so that the second exterior surface of the second engaging portion 312 closely fits a second interior surface of the second groove 21. The expansion 313 includes a first end adjacent to the first engaging portion 311, and a second end adjacent to the second engaging portion 312. The first end of the expansion 313 is abutted against the first positioning section 112 of the first groove 11, and the second end of the expansion 313 is abutted against and received in the second positioning section 212 of the second groove 21. Thus, the elastic member 31 cannot discretionarily be pivoted with respect to the shell 22 and the arm portion 12.

The first joining member 32 and the second joining member 33 are arranged along the centerline C. The first joining member 32 includes a first end and a second end space from the first end thereof. The first end of the first joining member 32 is disposed in the first engaging portion 311 of the elastic member 31, and the second end of the first joining member 32 is connected to the bottom section of the first groove 11 of the support member 10. The first joining member 32 includes a first embedded portion 321, a first threaded portion 322, a first expanded portion 323, and a first aperture 324. The first embedded portion 321 is arranged on the first end of the first joining member 32 and is engaged into the first engaging portion 311 of the elastic member 31. In the embodiment, the first embedded portion 321 has a hexagonal cross-section parallel to the centerline C. The first threaded portion 322 is arranged on the second end of the first joining member 32 and protrudes through the through-hole 111 of the bottom section of the first groove 11 to threadedly engage with a first nut 34. The first expanded portion 323 is located between the first embedded portion 321 and the first threaded portion 322. In the embodiment, the first expanded portion 323 has a circular cross-section perpendicular to the centerline C. The first aperture 324 is located at the first embedded portion 321 and extends parallel to the centerline C. The first embedded portion 321 has a first width W1 defined along a direction perpendicular to the centerline C. The first threaded portion 322 has a second width W2 defined along the direction perpendicular to the centerline C. The first expanded portion 323 has a third width W3 defined along the direction perpendicular to the centerline C. The third width W3 is greater than the first width W1, and the first width W1 is greater than the second width W2.

The second joining member 33 includes a first end and a second end space from the first end thereof. The first end of the second joining member 33 is disposed in the second engaging portion 312 of the elastic member 31, and the second end of the second joining member 33 is connected to the bottom section of the second groove 21 of the cushion assembly 20. The second joining member 33 includes a second embedded portion 331, a second threaded portion 332, a second expanded portion 333, and a second aperture 334. The second embedded portion 331 is arranged on the second end of the second joining member 33 and is engaged into the second engaging portion 312 of the elastic member 31. In the embodiment, the second embedded portion 331 has a hexagonal cross-section parallel to the centerline C. The second threaded portion 332 is arranged on the second end of the second joining member 33 and protrudes through a through-hole 211 of the bottom section of the second groove 21 to threadedly engage with a second nut 35. The second expanded portion 333 is located between the second embedded portion 331 and the second threaded portion 332. In the embodiment, the second expanded portion 333 has a circular cross-section perpendicular to the centerline C. The second aperture 334 is located at the second embedded portion 331 and extends parallel to the centerline C. The second embedded portion 331 has a fourth width W4 defined along the direction perpendicular to the centerline C. The second threaded portion 332 has a fifth width W5 defined along a direction perpendicular to the centerline C. The second expanded portion 333 has a sixth width W6 defined along a direction perpendicular to the centerline C. The sixth width W6 is greater than the fourth width W4, and with the fourth width W4 is greater than the fifth width W5.

In a preferred form, the elastic member 31 is formed of a solid rubber material and is made by the injection molding process. Thus, the first expanded portion 321 of the first joining member 32 and the second embedded portion 331 of the second joining member 33 are embedded in the first engaging portion 311 and the second engaging portion 312 of the elastic member 31. Moreover, the first expanded portion 323 and the first aperture 324 of the first joining member 32, and the second expanded portion 333 and the second aperture 334 of the second joining member 33 can increase the contact area between the elastic member 31 and the first and second joining members 32 and 33 for a strong connection relationship, and improves the operating life of the elastic member 31.

FIGS. 6-10 show various movement between the support member 10 and the cushion assembly 20 due to the elastic assembly 30 located between the support member 10 and the cushion assembly 20.

Figure 6:
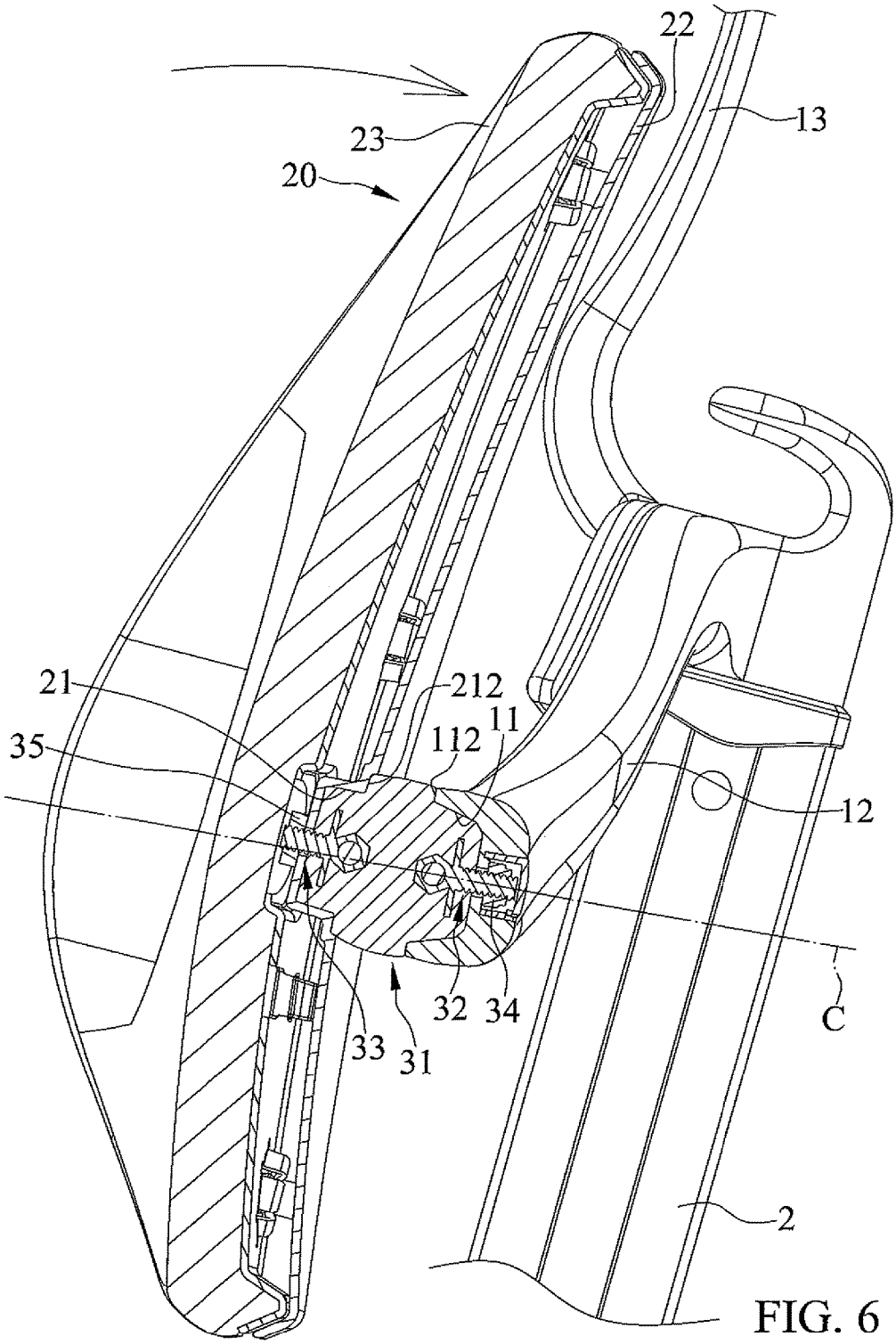
FIG. 6 is a partial, enlarged view of the back support cushion device of FIG. 4, and illustrating a top section of a cushion pad pressed by an external force.
Figure 7:
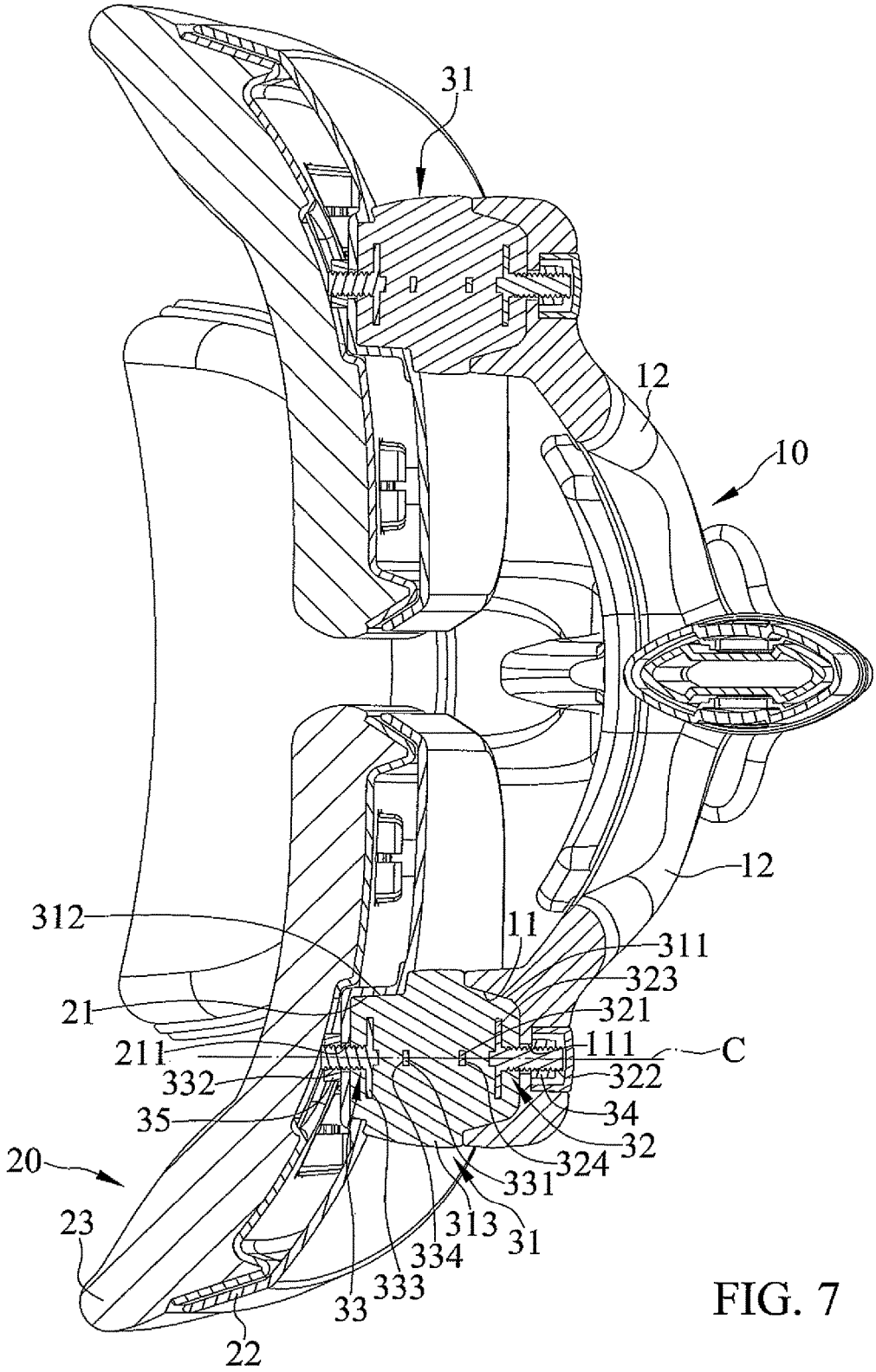
FIG. 7 is another partial, cross sectional view of the back support cushion device of FIG. 1.
Figure 8:
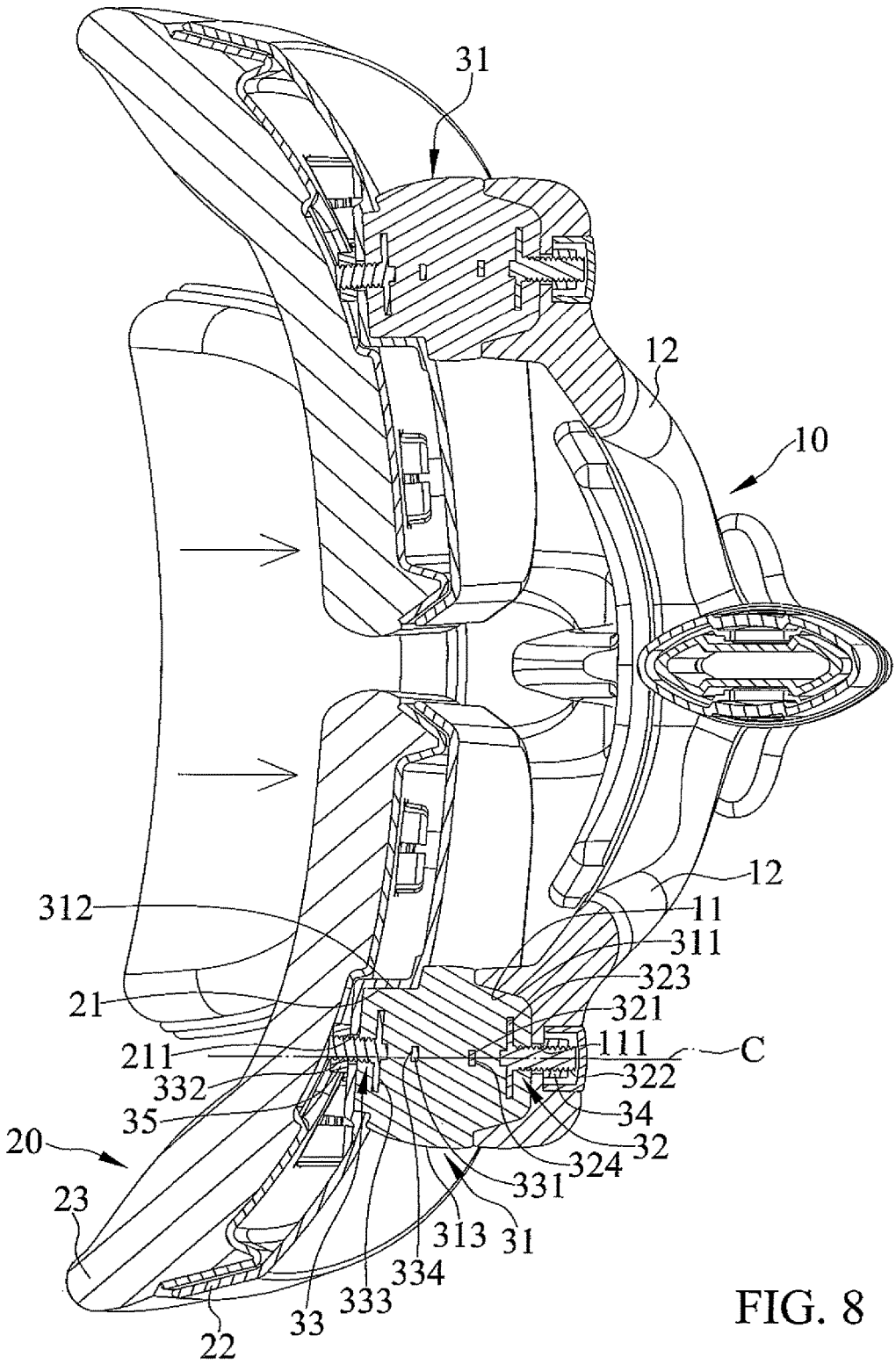
FIG. 8 is a continued view of the back support cushion device of FIG. 7, and illustrating an interior section of the cushion pad pressed by an external force.
Figure 9:
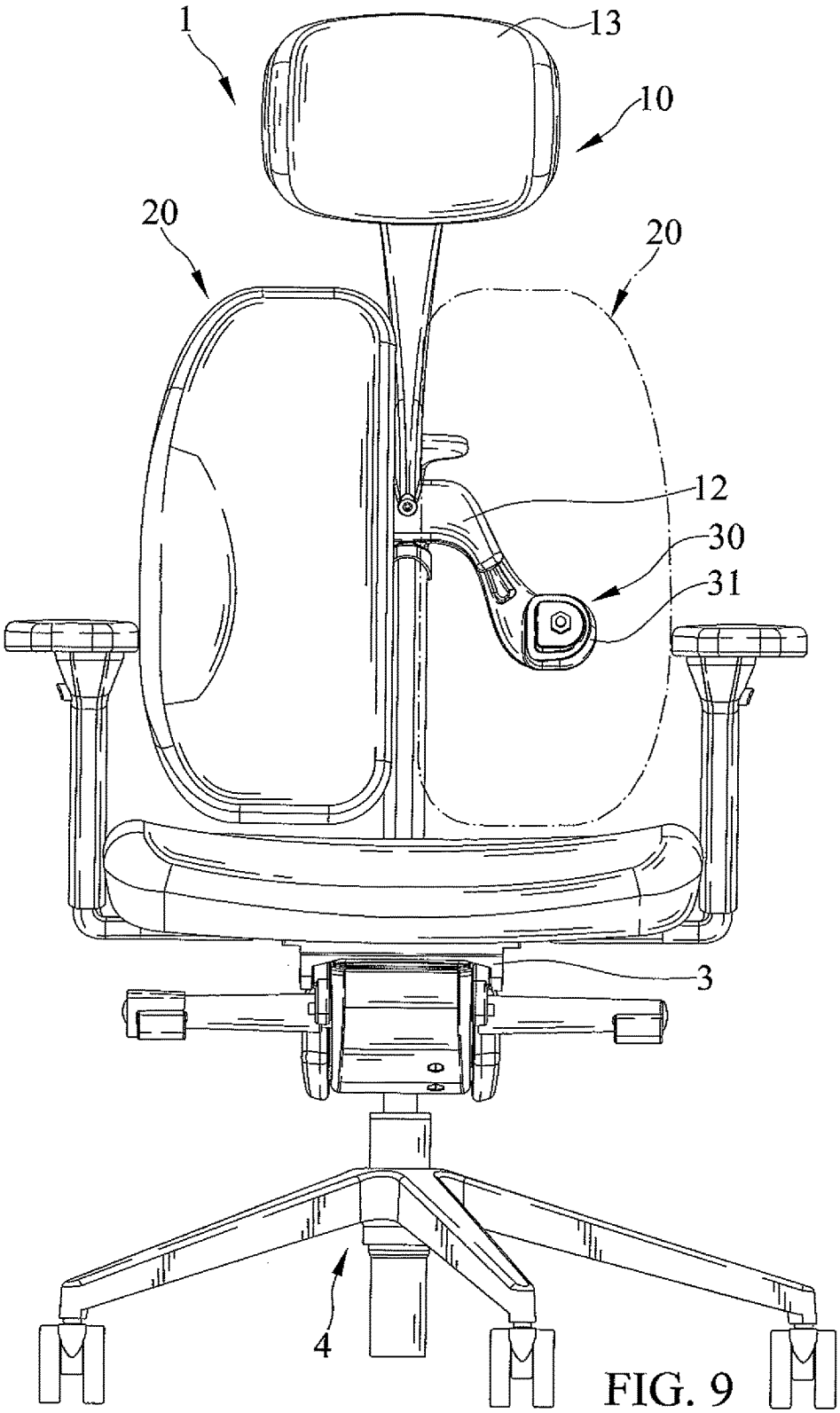
FIG. 9 is a rear view of the back support cushion device of FIG. 1, and illustrating a cushion assembly indicated by the broken line.
Figure 10:
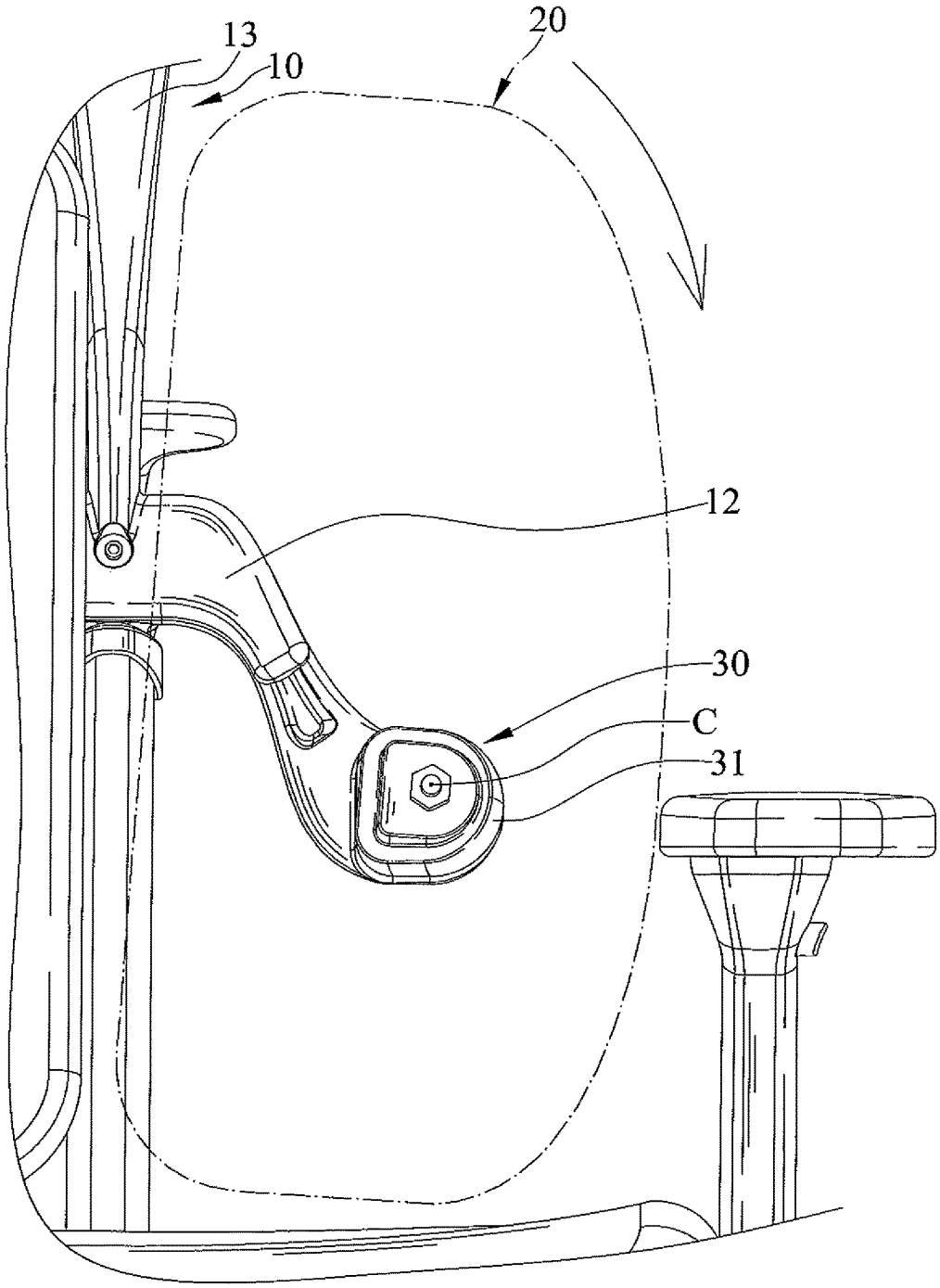
FIG. 10 is a continued view of the back support cushion device of FIG. 9, and illustrating the cushion assembly twisted with respect to a support member.

In the FIG. 6, a top section of the cushion pad 23 can be pressed by an external force from a person to cause the cushion pad 23 pivoted in relation to the support member 10 for fittingly supporting the person's back. Likewise, in the FIG. 8, an interior section of the cushion pad 23 can be pressed by the external force from the person to cause the cushion pad 23 pivoted in relation to the support member 10 for fittingly supporting the person's back and for absorbing the pressure. Additionally, in the FIG. 10, the cushion assembly 30 can be twisted with respect to the support member 10 due to the elasticity of the elastic member 31.

In view of the foregoing, the back support cushion device 1 according to the present invention includes the elastic assembly 30 located between the support member 10 and the cushion assembly 20. The elastic assembly 30 includes the elastic member 31, which has elasticity to enable the cushion assembly 20 to be pivoted in relation to the support member 10 and has a stronger structure to avoid the first and second joining members 32 and 33 disengaged from the elastic member 31.

Although preferred embodiments of the present invention have been illustrated and described, they should not be construed to restrict the scope of the present invention. Therefore, modifications to numerical values or substitution of equivalent elements thereof or equivalent changes and modifications based on the accompanying claims of the present invention still fall within the scope covered by the present invention.

The invention claimed is:

1. A back support cushion device comprising:

a support member including at least one first groove;

at least one cushion assembly including a second groove; and at least one elastic assembly located between the support member and the at least one cushion assembly, with the at least one elastic assembly including an elastic member, a first joining member, and a second joining member, with the elastic member including a first engaging portion and a second engaging portion spaced from the first engaging portion, with the first engaging portion including a first exterior surface having at least two different curvatures, with the first engaging portion of the elastic member engaged into the at least one first groove of the support member, with the second engaging portion including a second exterior surface having at least two different curvatures, with the second engaging portion of the elastic member engaged into the second groove of the at least one cushion assembly, with the first joining member including a first end and a second end space from the first end thereof, with the first end of the first joining member disposed in the first engaging portion of the elastic member, with the second end of the first joining member connected to a bottom section of the at least one first groove of the support member, with the second joining member including a first end and a second end space from the first end thereof, with the first end of the second joining member disposed in the second engaging portion of the elastic member, and with the second end of the second joining member connected to a bottom section of the second groove of the at least one cushion assembly.

2. The back support cushion device as claimed in claim 1, with the first joining member including a first embedded portion and a first threaded portion, with the first embedded portion arranged on the first end of the first joining member and engaged into the first engaging portion of the elastic member, with the first threaded portion arranged on the second end of the first joining member and protruding through a through-hole of a bottom section of the at least one first groove to threadedly engage with a first nut, with the second joining member including a second embedded portion and a second threaded portion, with the second embedded portion arranged on the second end of the second joining member and engaged into the second engaging portion of the elastic member, and with the second threaded portion arranged on the second end of the second joining member and protruding through a through-hole of a bottom section of the second groove to threadedly engage with a second nut.

3. The back support cushion device as claimed in claim 2, with the elastic member having a centerline extending therethrough, with the first joining member and the second joining member arranged along the centerline, with the first embedded portion of the first joining member having a hexagonal cross-section parallel to the centerline, and with the second embedded portion of the second joining member having a hexagonal cross-section parallel to the centerline.

4. The back support cushion device as claimed in claim 3, with the first joining member including a first expanded portion located between the first embedded portion and the first threaded portion, with the first expanded portion having a circular cross-section perpendicular to the centerline, with the second joining member including a second expanded portion located between the second embedded portion and the second threaded portion, and with the second expanded portion having a circular cross-section perpendicular to the centerline.

5. The back support cushion device as claimed in claim 4, with the first embedded portion of the first joining member having a first width defined along a direction perpendicular to the centerline, with the first threaded portion of the first joining member having a second width defined along the direction perpendicular to the centerline, with the first expanded portion of the first joining member having a third width defined along the direction perpendicular to the centerline, with the third width greater than the first width, with the first width greater than the second width, with the second embedded portion of the second joining member having a fourth width defined along the direction perpendicular to the centerline, with the second threaded portion of the second joining member having a fifth width defined along a direction perpendicular to the centerline, with the second expanded portion of the second joining member having a sixth width defined along the direction perpendicular to the centerline, with the sixth width greater than the fourth width, and with the fourth width greater than the fifth width.

6. The back support cushion device as claimed in claim 5, with the first joining member including a first aperture located at the first embedded portion and extending parallel to the centerline, and with the second joining member including a second aperture located at the second embedded portion and extending parallel to the centerline.

7. The back support cushion device as claimed in claim 5, with the at least one first groove including a first positioning section formed around an end face thereof, with the second groove including a second positioning section formed around an end face thereof and expanding therefrom, the elastic member including an expansion located between the first engaging portion and second engaging portion, with the expansion including a first end adjacent to the first engaging portion, and a second end adjacent to the second engaging portion, with the first end of the expansion abutted against the first positioning section of the at least one first groove, and with the second end of the expansion abutted against and received in the second positioning section of the second groove.

8. The back support cushion device as claimed in claim 1, with the support member including at least one arm portion, with the at least one first groove formed on a terminal end of the at least one arm portion, with the at least one cushion assembly including a shell and a cushion pad, with the second groove formed on a back surface of the shell facing to the support member, and with the cushion pad mounted to a front surface of the shell.

9. The back support cushion device as claimed in claim 8, with the support member including a pair of arm portions and a head support located between the pair of arm portions.

10. The back support cushion device as claimed in claim 1, with the elastic member formed of a solid rubber material.

* * * * *